US006588405B1

(12) United States Patent
Streicher et al.

(10) Patent No.: US 6,588,405 B1
(45) Date of Patent: Jul. 8, 2003

(54) PUMP SYSTEM FOR SUPPLYING FUEL AT HIGH PRESSURE

(75) Inventors: Bernd Streicher, Filderstadt (DE); Thomas Schwarz, Schorndorf (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/600,917

(22) PCT Filed: Jan. 18, 1999

(86) PCT No.: PCT/DE99/00088

§ 371 (c)(1),
(2), (4) Date: Sep. 26, 2000

(87) PCT Pub. No.: WO99/37910

PCT Pub. Date: Jul. 29, 1999

(30) Foreign Application Priority Data

Jan. 23, 1998 (DE) ..... 198 02 476

(51) Int. Cl.[7] ..... F02M 37/04
(52) U.S. Cl. ..... 123/495; 123/456
(58) Field of Search ..... 123/495, 468, 123/469, 470, 456, 509, 508; 417/273, 269, 62

(56) References Cited

U.S. PATENT DOCUMENTS 3,119,340 A * 1/1964 Scibbe ..... 417/473
5,255,658 A * 10/1993 Hoffer et al. ..... 123/531
5,463,997 A * 11/1995 Cutler ..... 123/460
5,701,872 A * 12/1997 Kaku et al. ..... 123/495
5,956,953 A * 9/1999 Folsom et al. ..... 60/491
5,970,956 A * 10/1999 Sturman ..... 123/508
6,009,854 A * 1/2000 Rosgren et al. ..... 123/456
6,223,726 B1 * 5/2001 Jung et al. ..... 123/468

* cited by examiner

*Primary Examiner*—Carl S. Miller
(74) *Attorney, Agent, or Firm*—Ronald E. Greigg

(57) ABSTRACT

The invention relates to a pump device for high pressure fuel delivery in fuel injection systems of internal combustion engines including a pump housing. The pump housing includes a number of pump elements, in which high pressure is exerted on fuel. The fuel that is acted on with high pressure is delivered by the individual pump elements to a common high pressure connecting bore by use of a high pressure conduit system. In order to reduce stress in the bores the high pressure conduit system includes a number of high pressure conduits which communicate with the pump elements and are disposed in a plane different from that of the common high pressure connecting bore in which the high pressure conduits come together at the connecting bore. Through the disposition of the common high pressure connecting bore in a plane different from that of the high pressure conduits, the high pressure conduits can intersect with the high pressure connecting bore in an eccentric fashion.

4 Claims, 5 Drawing Sheets

PUMP SYSTEM FOR SUPPLYING FUEL AT HIGH PRESSURE

PRIOR ART

The invention relates to a pump device for high pressure fuel delivery in fuel injection systems of internal combustion engines, particularly in a common rail injection system. The pump includes a pump housing, which includes a number of pump elements in which high pressure is exerted on fuel. The fuel that is acted on with high pressure is supplied by the individual pump elements to a common high pressure connecting bore by means of a high pressure conduit system.

In modern fuel injection systems of internal combustion engines, particularly in common rail injection systems of diesel engines, fuel pressures of up to 2000 bar are produced. Conventional pump devices are often unable to withstand these high fuel pressures.

In a conventional pump device, at pressures of up to 2000 bar in the delivery direction, impermissibly high stresses have been measured in the high pressure conduit system, primarily at the intersections of the individual conduits.

An object of the invention, therefore, is to optimize the high pressure conduit routing between the individual pump elements and the high pressure connection. In particular, stress peaks should be minimized at bore intersections.

In a pump device for high pressure fuel delivery in fuel injection systems of internal combustion engines, particularly in a common rail injection system, with a pump housing, which includes a number of pump elements in which high pressure is exerted on fuel, wherein the fuel that is acted on with high pressure is supplied by the individual pump elements to a common high pressure connecting bore by means of a high pressure conduit system. An object is attained by virtue of the fact that the high pressure conduit system includes a number of high pressure conduits which communicate with the pump elements and are disposed in a plane different from that of the common high pressure connecting bore in which the high pressure conduits come together. Through the disposition of the high pressure conduits in one plane, the same parts can be used for each high pressure valve. Through the disposition of the common high pressure connecting bore in a plane different from that of the high pressure conduits, the high pressure conduits can intersect with the high pressure connecting bore in an eccentric fashion. This means that the center lines of the high pressure conduits no longer intersect with the center line of the high pressure connecting bore. As a result, the stress peaks in the bore intersections are reduced. This produces the advantage that a durability of the pump housing is assured even at pressures of up to 2000 bar. Furthermore, the pump device according to the invention has the advantage that it can be inexpensively manufactured.

One particular embodiment of the invention is characterized in that at least one of the high pressure conduits passes through the outside of the high pressure connecting bore, essentially tangential to it. The plane that contains the high pressure connection is offset in relation to the plane that contains the high pressure conduits to the extent that the high pressure conduit passes through the high pressure connecting bore in an off-center, tangential fashion. This prevents dead water zones at the intersections. In addition to more favorable flow conditions, this produces the advantage that an optimal cleaning of the high pressure conduit system is assured during manufacturing. In connection with the current invention, the term "tangential" is understood to signify an option that does not absolutely have to be exercised. Manufacturing tolerances (angle, position, straightness, diameter) must be taken into consideration in the construction. Since the bores, for strength reasons, are not permitted to cut into the circumference surface of the lateral bores, structural allowances must be made for the maximal tolerance situation. A reduction of the stresses is already achieved with an off-center penetration of the bores, which does not absolutely have to be tangential.

Another particular embodiment of the invention is characterized by means of the fact that at least one of the high pressure conduits feeds into the outlet of the high pressure connecting bore, which outlet is embodied as ball-shaped. By embodying the high pressure connecting bore in the shape of a ball, bore intersections can be realized with greater angles than in bores which are produced with conventional drills. Additional indentations in the outlet of the high pressure connecting bore are also prevented.

Another particular embodiment of the invention is characterized in that the high pressure conduits pass through the blind openings in an off-center fashion. This reduces stresses.

The current invention generally produces the advantage that large diameter differences between the high pressure conduits and the high pressure connecting bore can be realized in a manner that is favorable for technical flow reasons.

Other advantages, features, and details of the invention ensue from the dependent claims as well as the subsequent description in which two exemplary embodiments are described in detail with reference to the drawings. The features mentioned in the claims and in the description can be essential to the invention individually or in arbitrary combinations.

DETAILED DESCRIPTION

The pump device according to the invention can, for example, be a radial piston pump. Radial piston pumps are used in particular in common rail injection systems for fuel delivery in diesel engines. In this connection, "common rail" means the same thing as "common line" or "common distributor rail". In contrast to conventional high pressure injection systems in which the fuel is supplied to the individual combustion chambers by means of separate lines, the fuel injectors in common rail injection systems are supplied from a common line.

The pump elements of a radial piston pump can be constituted by cylinder chambers disposed radial to a drive shaft, each of which contains a piston in such a way that the piston can move back and forth. The pistons are used to exert high pressure on fuel in the cylinder chambers. The fuel that is acted on with high pressure is then supplied to the common distributor rail by means of a high pressure conduit system and a high pressure connection.

Figure 1:
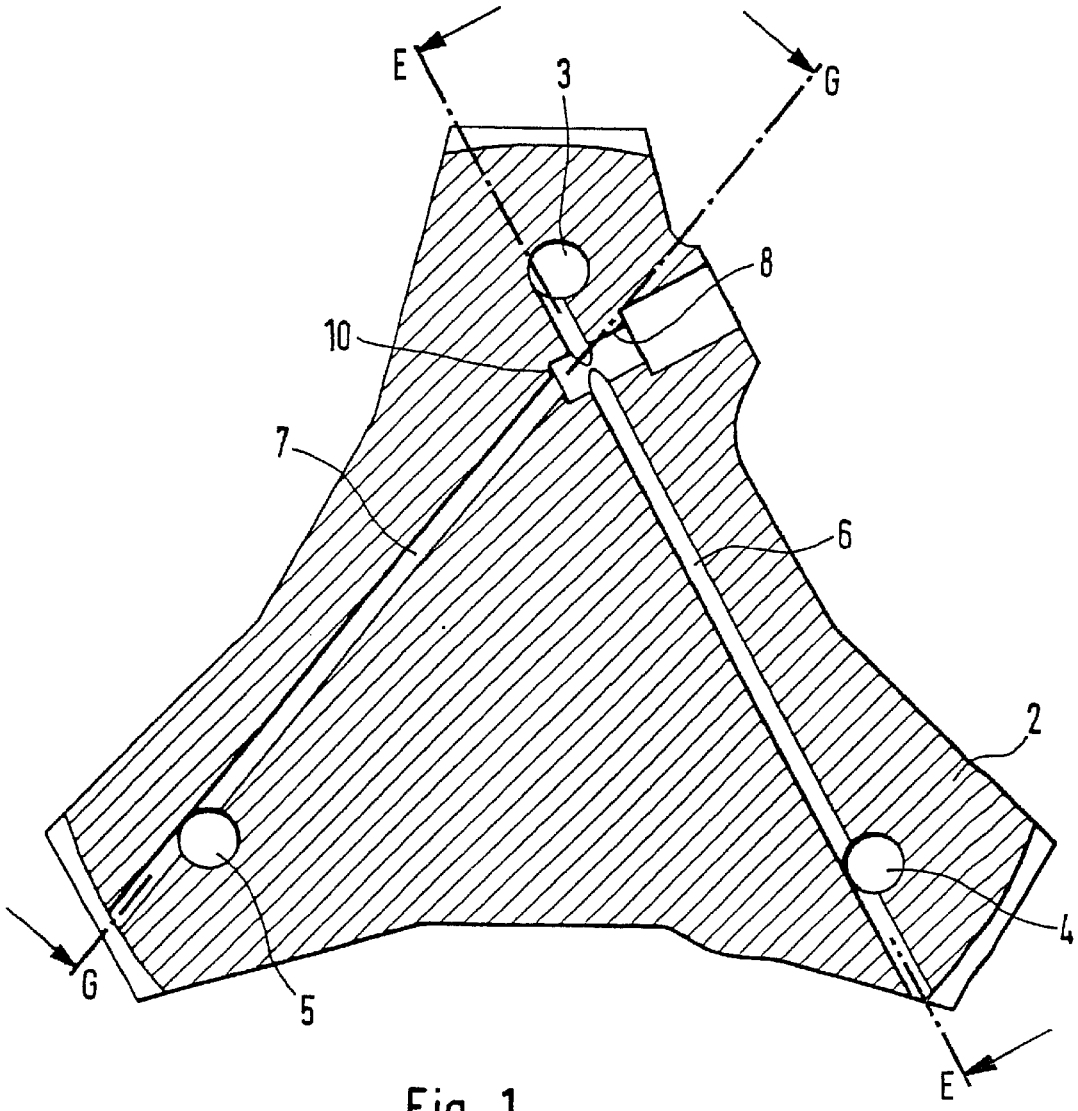
FIG. 1 shows a section through a pump device according to a first embodiment of the current invention, wherein the section shown extends along the line F—F in FIG. 2.

FIG. 1 shows a sectional view of a high pressure pump. Three blind bores 3, 4, and 5 are depicted in a pump housing part 2 and each of them respectively communicates with one of the pump elements by means of bores that are not shown (also see FIG. 2). Two high pressure conduits 6 and 7 extend tangent to the blind bores 3, 4, and 5. The high pressure conduit 6 connects the blind bores 3 and 4 to each other and passes through a high pressure connecting bore 8 whose diameter is greater than the diameter of the high pressure conduits.

Figure 2:
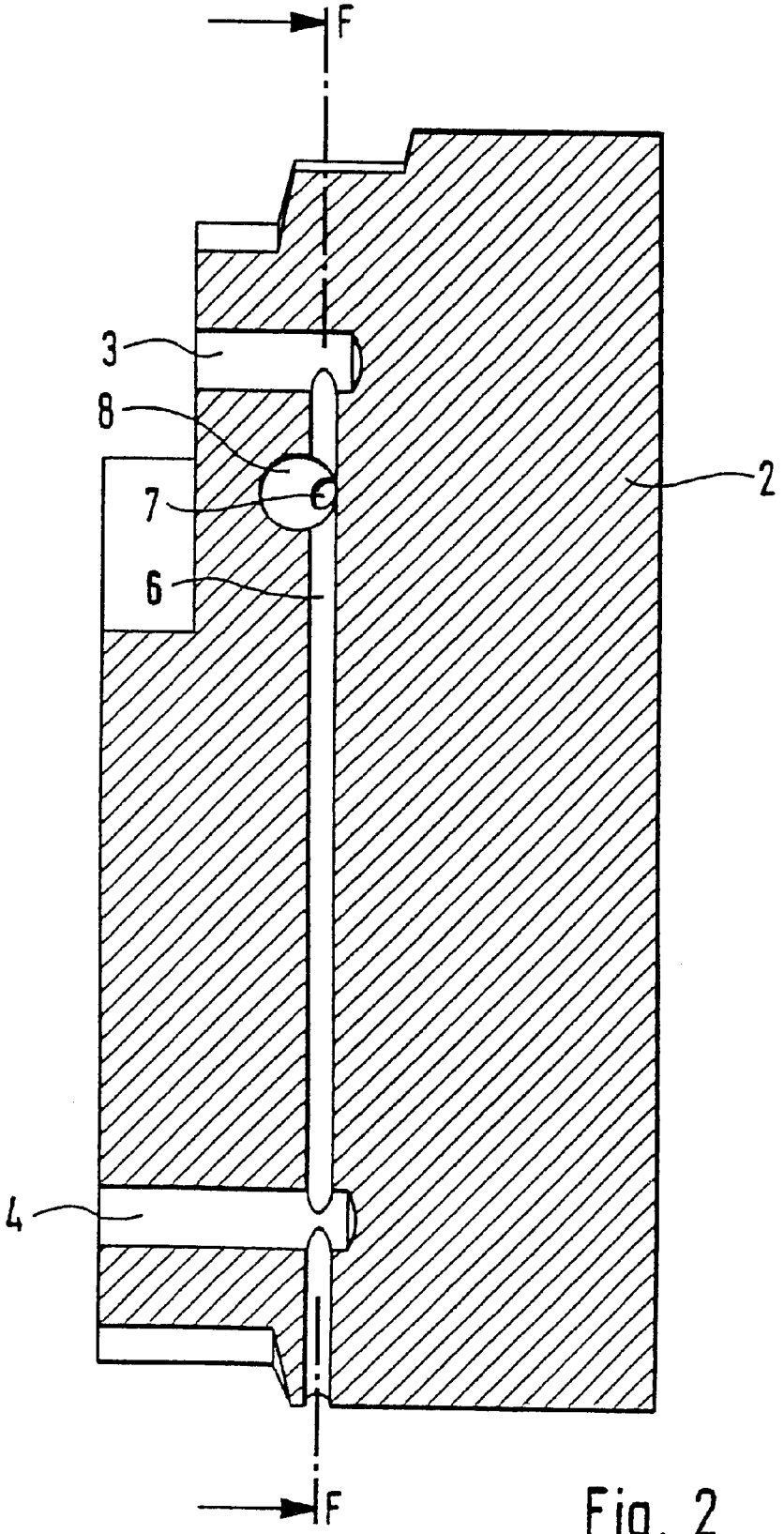
FIG. 2 shows a section along the line E—E in FIG. 1.

The high pressure conduits 6 and 7 extend in a plane that corresponds to the plane of the drawing in FIG. 1. As can be seen from the sectional depictions in FIGS. 2 and 3, the high pressure connecting bore 8 extends in a plane parallel to the high pressure conduits 6 and 7. The distance between the parallel plans is selected so that the high pressure conduit 6 passes through the high pressure connecting bore 8 in an essentially tangential fashion. FIG. 2 shows that on one side, the circumference surface of the high pressure conduit 6 is tangential to the high pressure connecting bore and on the other side, it intersects with the circumference surface of the high pressure connecting bore in an almost perpendicular fashion.

The high pressure conduits 7 connects the blind bore 5 to the high pressure connecting bore 8. As a result, the high pressure conduit 7 feeds into the high pressure connecting bore 8 in an off-center and essentially tangential fashion, as can be seen from the section depicted in FIG. 3.

It should also be noted that the high pressure conduits 6 and 7 also pass through the blind bores 3, 4, and 5 in an essentially tangential and off-center fashion.

Figure 3:
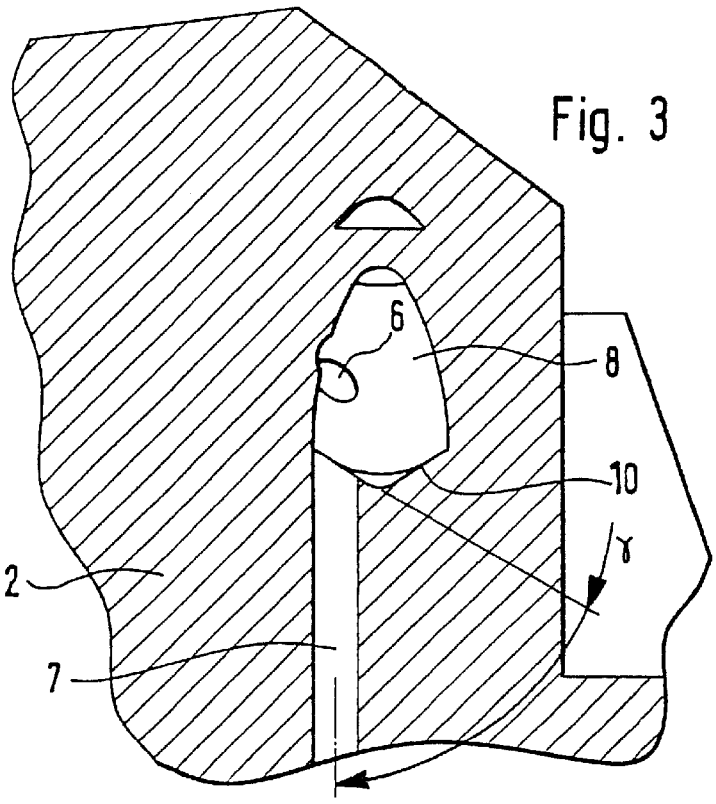
FIG. 3 shows an enlarged partial view of a section along the line G—G in FIG. 1 at a scale of 2:1.
Figure 6:
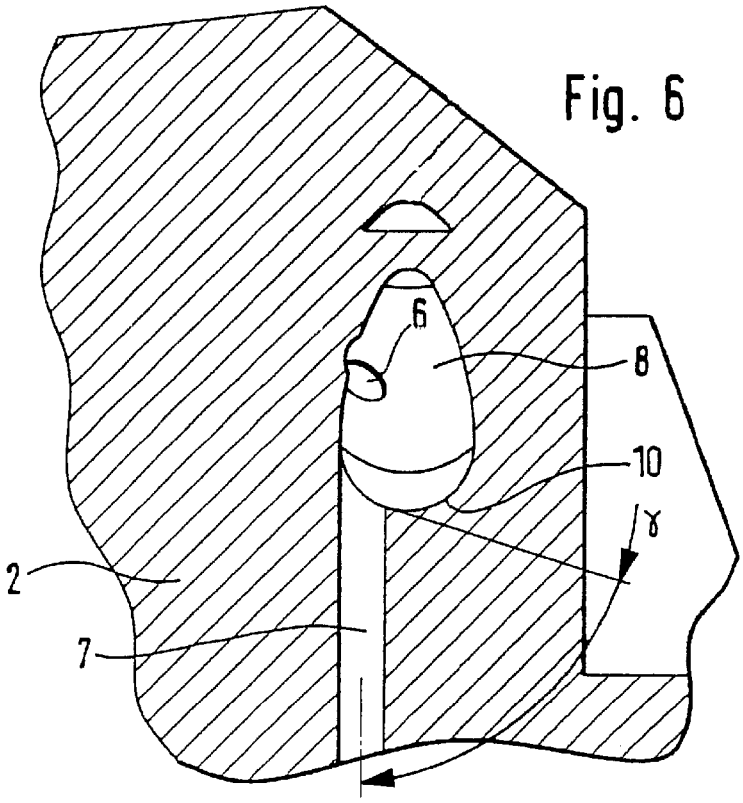
FIG. 6 shows an enlarged partial view of a section along the line G—G in FIG. 4 at a scale of 2:1.
Figure 4:
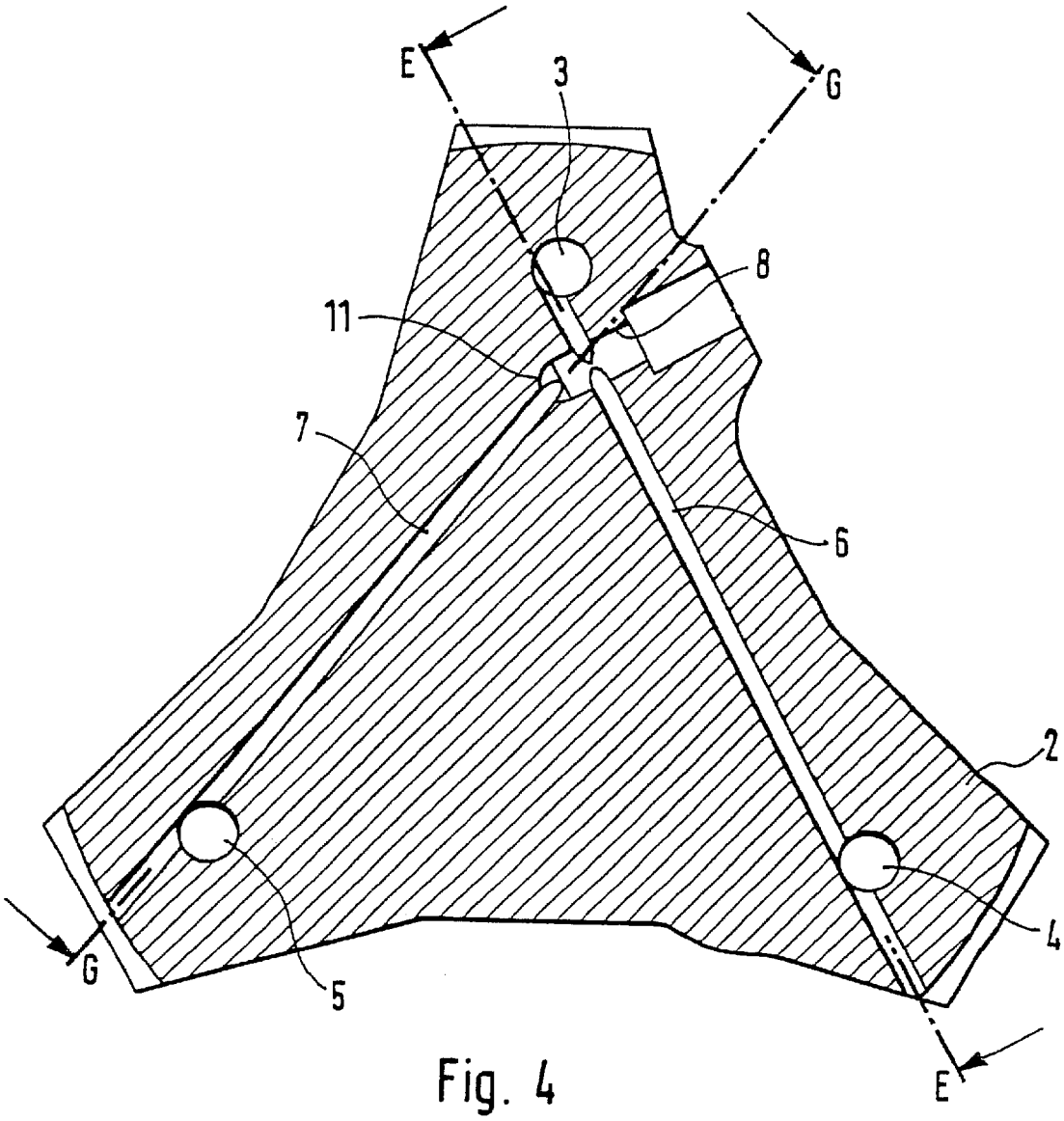
FIG. 4 shows a section through a pump device according to a second embodiment of the current invention, wherein the section shown extends along the line F—F in FIG. 5.
Figure 5:
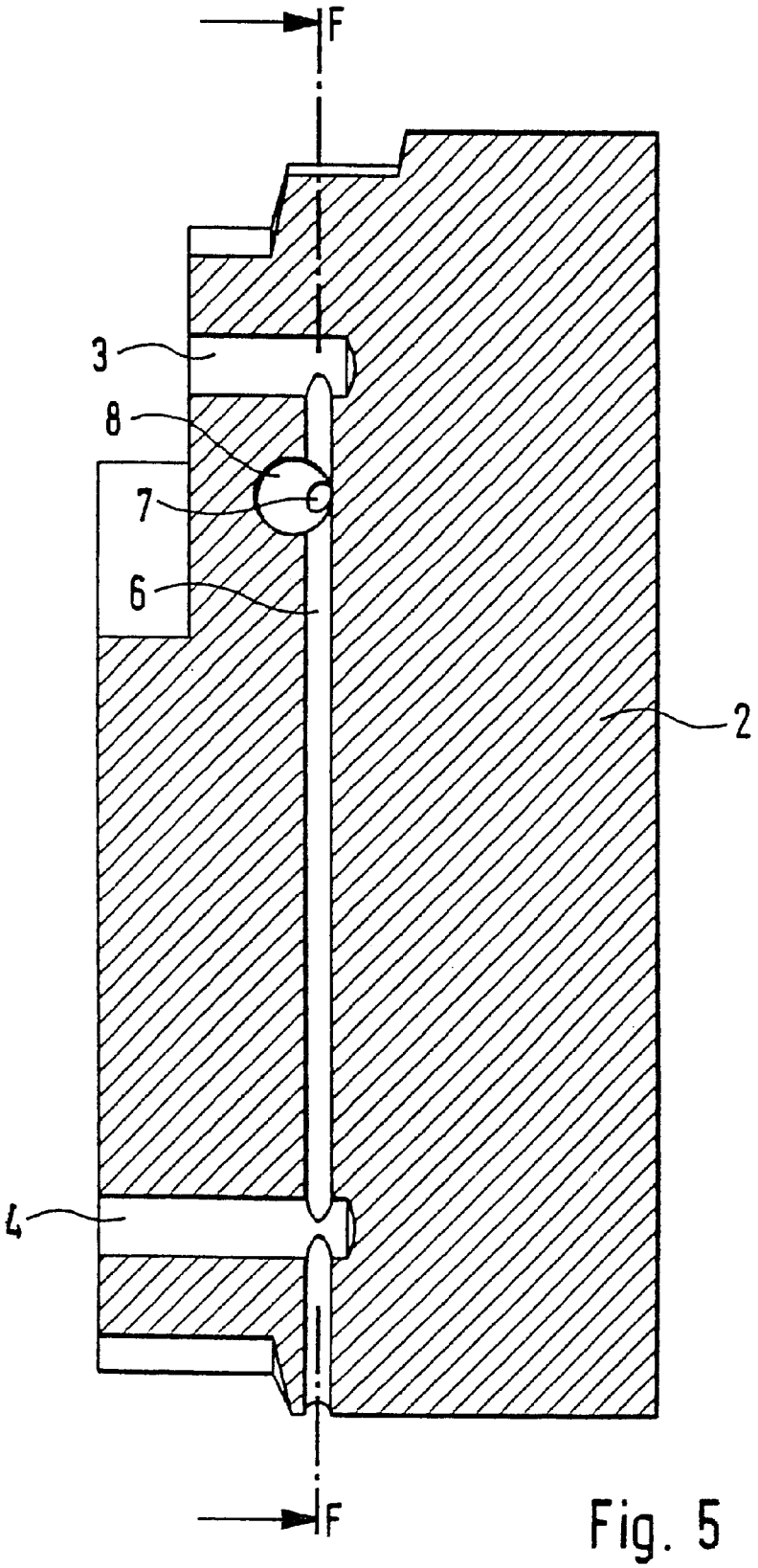
FIG. 5 shows a section along the line E—E in FIG. 4.

The embodiment of the current invention shown in FIGS. 4 to 6 largely corresponds to the embodiment shown in FIGS. 1 to 3. In order to avoid repetition, mainly the differences between the two embodiments will be discussed in the description below. For the sake of simplicity, parts which are present in both embodiments are provided with the same reference numerals.

As can be seen from FIG. 4, the high pressure connecting bore 8 has a spherical or ball-shaped outlet 11. The embodiment shown in FIG. 1 has an outlet 10 that is tapered at an angle of approximately 120° and is produced by a normal drill bit. As shown in the section depicted in FIG. 3, the angle $\alpha$ between the high pressure conduit 7 and the outlet of the high pressure connecting bore 8 is approximately 60°. In contrast, in the section shown in FIG. 6, the angle $\alpha$ between the high pressure conduit 7 and the outlet 11 of the high pressure connecting bore 8 is approximately 75°, which is more favorable with regard to the magnitude of the stresses at the bore intersection and is more favorable for technical flow reasons.

According to the current invention, all of the high pressure conduits transition into high pressure bores with a larger diameter in an off-center and essentially tangential fashion. The essentially tangential passage is thereby realized although the high pressure conduits are disposed in the same plane.

The foregoing relates to a preferred exemplary of embodiments of the invention, it being understood that other variants and embodiments thereof are possible within the spirit and scope of the invention, the latter being defined by the appended claims.

We claim:

1. A pump device for high pressure fuel delivery in fuel injection systems of internal combustion engines comprising a common rail injection system, a pump housing (2) in which high pressure is exerted on fuel by a number of pump elements, the fuel that is acted on with high pressure is delivered to a common high pressure connecting bore (8) by means of a high pressure conduit system, the high pressure conduit system includes a number of high pressure conduits (6, 7) in the housing, which communicates with the pump elements and are disposed in a plane different from that of the common high pressure connecting bore (8) in which the high pressure conduits (6, 7) come together, in which the pump housing is provided with blind bores (3, 4, 5) communicating with the pump elements and the high pressure conduits (6 and 7) pass through the blind bores (3, 4, 5) in an off-center fashion.

2. The pump device according to claim 1, in which at least one of the high pressure conduits (6) passes through tangentially an outside of the high pressure connecting bore (8).

3. The pump device according to claim 1, in which at least one of the high pressure conduits (7) feeds into an outlet (11) of the high pressure connecting bore (8), and the outlet (11) is embodied as ball-shaped.

4. The pump device according to claim 2, in which at least one of the high pressure conduits (7) feeds into an outlet (11) of the high pressure connecting bore (8), and the outlet (11) is embodied as ball-shaped.

* * * * *